US009624014B2

(12) United States Patent
Marsh

(10) Patent No.: US 9,624,014 B2
(45) Date of Patent: Apr. 18, 2017

(54) GIFT BOX WITH SPECIAL EFFECTS

(71) Applicant: American Greetings Corporation, Cleveland, OH (US)

(72) Inventor: Allison Marsh, Olmsted Township, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 15/165,370

(22) Filed: May 26, 2016

(65) Prior Publication Data

US 2016/0272386 A1 Sep. 22, 2016

Related U.S. Application Data

(62) Division of application No. 15/000,536, filed on Jan. 19, 2016, now Pat. No. 9,533,804.

(60) Provisional application No. 62/105,268, filed on Jan. 20, 2015.

(51) Int. Cl.

| | |
|---|---|
| ***A47F 11/06*** | (2006.01) |
| ***B65D 51/24*** | (2006.01) |
| ***F21V 23/04*** | (2006.01) |
| ***F21V 33/00*** | (2006.01) |
| ***B65D 5/42*** | (2006.01) |
| *F21W 121/00* | (2006.01) |

(52) U.S. Cl.

CPC ..... *B65D 51/245* (2013.01); *B65D 5/425* (2013.01); *B65D 51/248* (2013.01); *F21V 23/04* (2013.01); *F21V 33/0056* (2013.01); *B65D 2203/12* (2013.01); *F21W 2121/00* (2013.01)

(58) Field of Classification Search

USPC ..... 40/312, 427, 442, 551, 124.02

See application file for complete search history.

(56) References Cited

U.S. PATENT DOCUMENTS

| | | | | |
|---|---|---|---|---|
| 3,553,868 A * | 1/1971 | Swartz | G09F 19/00 | 40/427 |
| 4,497,126 A * | 2/1985 | Dejean | B42D 15/02 | 283/117 |
| 4,811,506 A * | 3/1989 | Mehta | G09F 19/02 | 40/411 |
| 5,641,164 A * | 6/1997 | Doederlein | B42D 15/022 | 273/237 |

* cited by examiner

*Primary Examiner* — Joanne Silbermann

(74) *Attorney, Agent, or Firm* — Christine Flanagan

(57) ABSTRACT

This invention is directed to a gift box for presenting a gift or other item to a recipient. The gift box contains various electronic components contained in some portion of the box which are used to effect, movement, sound, light or other special effects. The box may have one or more special effects which can be triggered automatically or by interaction with a user or gift box recipient.

8 Claims, 7 Drawing Sheets

GIFT BOX WITH SPECIAL EFFECTS

RELATED APPLICATIONS

This application is a divisional of U.S. patent application Ser. No. 15/000,536, filed on Jan. 19, 2016, which is a non-provisional of and claims priority to U.S. Provisional Patent Application No. 62/105,268, filed on Jan. 20, 2015. Each of the above-referenced documents is incorporated herein by reference in its entirety.

FIELD OF THE INVENTION

This invention is in the field of social expression products, specifically to gift containers such as gift boxes having motorized movement, sound, light and other special effects.

SUMMARY OF THE INVENTION

This invention is directed to a gift box for presenting a gift or other item to a recipient. The gift box contains various electronic components contained in some portion of the box which are used to effect movement, sound, light or other special effects. The box may have one or more special effects which can be triggered automatically or by interaction with a user or gift box recipient.

DETAILED DESCRIPTION OF PREFERRED AND ALTERNATE EMBODIMENTS

The gift box of the present invention contains various electronic components contained within the gift box which enable sound, light and/or motor movement of certain parts or aspects of the box. The box includes a base B which contains four sides or panels B1, B2, B3, B4 which are arranged perpendicular to a bottom or floor panel B5, the side B1, B2, B3, B4 and floor B5 panels creating an interior cavity or area for containing gifts or other items therein. The box also includes a lid L which contains a top or cover panel L5 with four sides or panels L1, L2, L3, L4 which are arranged perpendicular to the cover panel. The lid L is slightly larger than the base B so that the lid L fits snugly over the top of the base B to provide a covered, closed interior space therein. While the box is being described herein as having four sides, as in a square or rectangular shape similar to a traditional box, the box may alternately contain three or more sides which are arranged various configurations, such as a triangular configuration, pentagonal, octagonal, etc. The box may alternatively contain a single curved side wall panel arranged in a circular arrangement. The base B and lid L of the box would take on the same shapes in each circumstance. In a preferred embodiment, however, the box contains four sides. The box may be made of cardboard, corrugate, plastic, wood, or any other suitably strong material. The outer surface of the box may contain a planar sheet material attached thereto to provide a decorative effect. The planar sheet material may have various textures, such as a smooth texture, glossy texture, rough texture, embossed texture, furry texture, etc. The sheet material may also contain various embellishments attached thereto, including but not limited to gems, googly eyes, or other such attachments. The lid L many be completely separate from the base B or it may be a hinged lid which is permanently attached thereto along one side edge. Alternatively, the lid L may be removably attached to the base B via a snap, Velcro®, or other releasable attachment mechanism. This description applies to both embodiments as further presented below.

Figure 1:
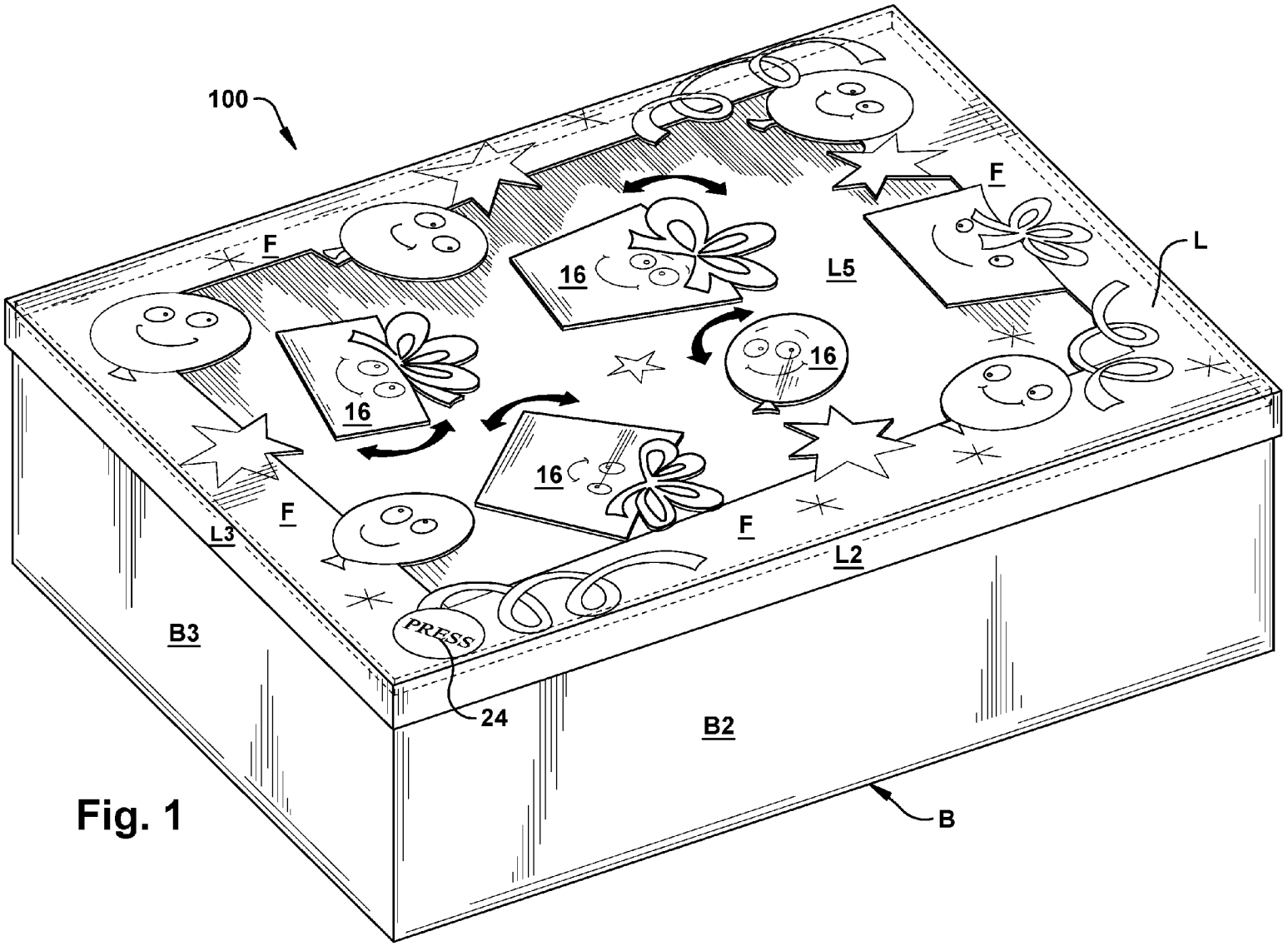
FIG. 1 is a perspective view of a first embodiment of the gift box of the present invention.
Figure 2:
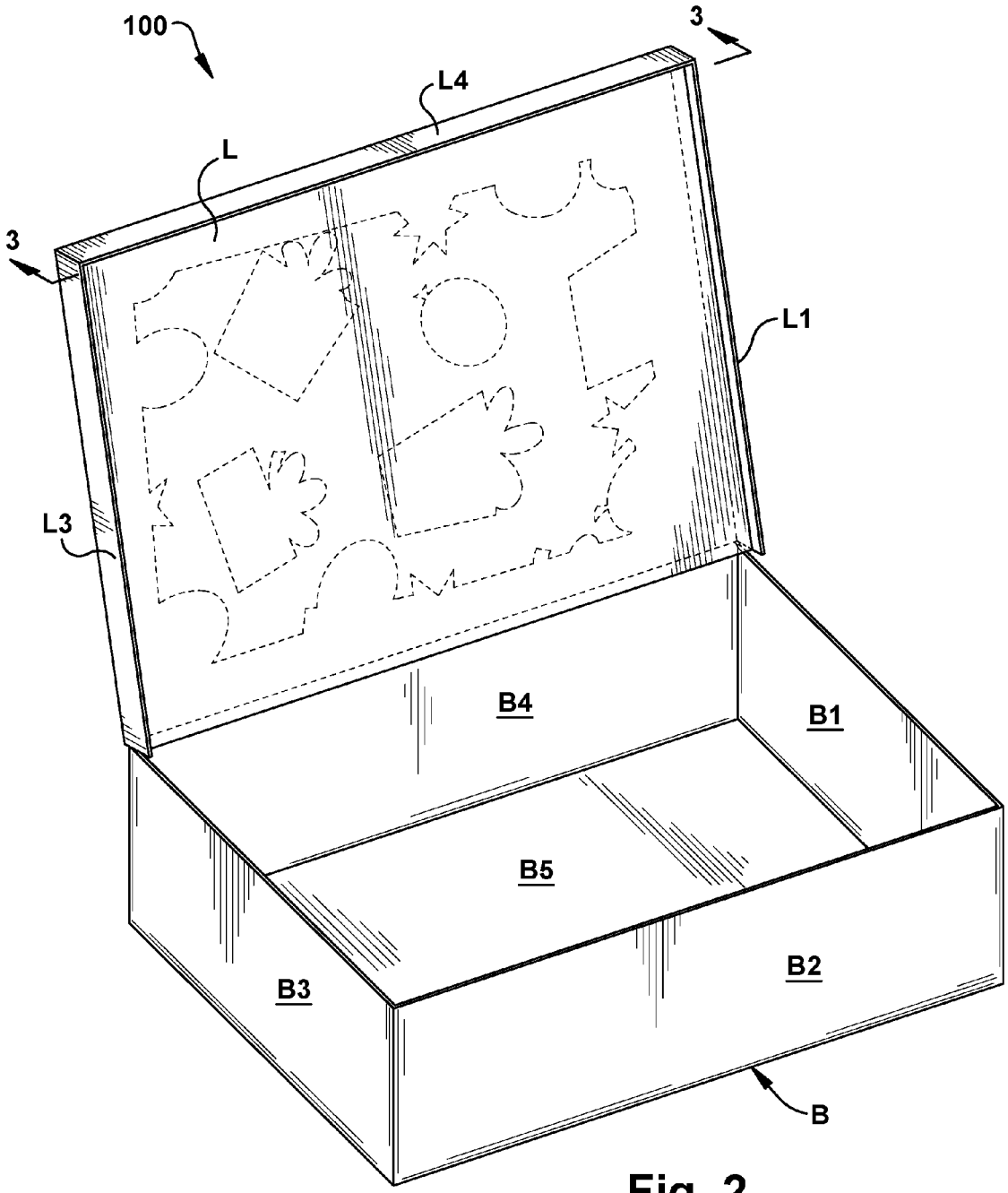
FIG. 2 is a perspective view of the gift box of FIG. 1, in an open position.
Figure 3:
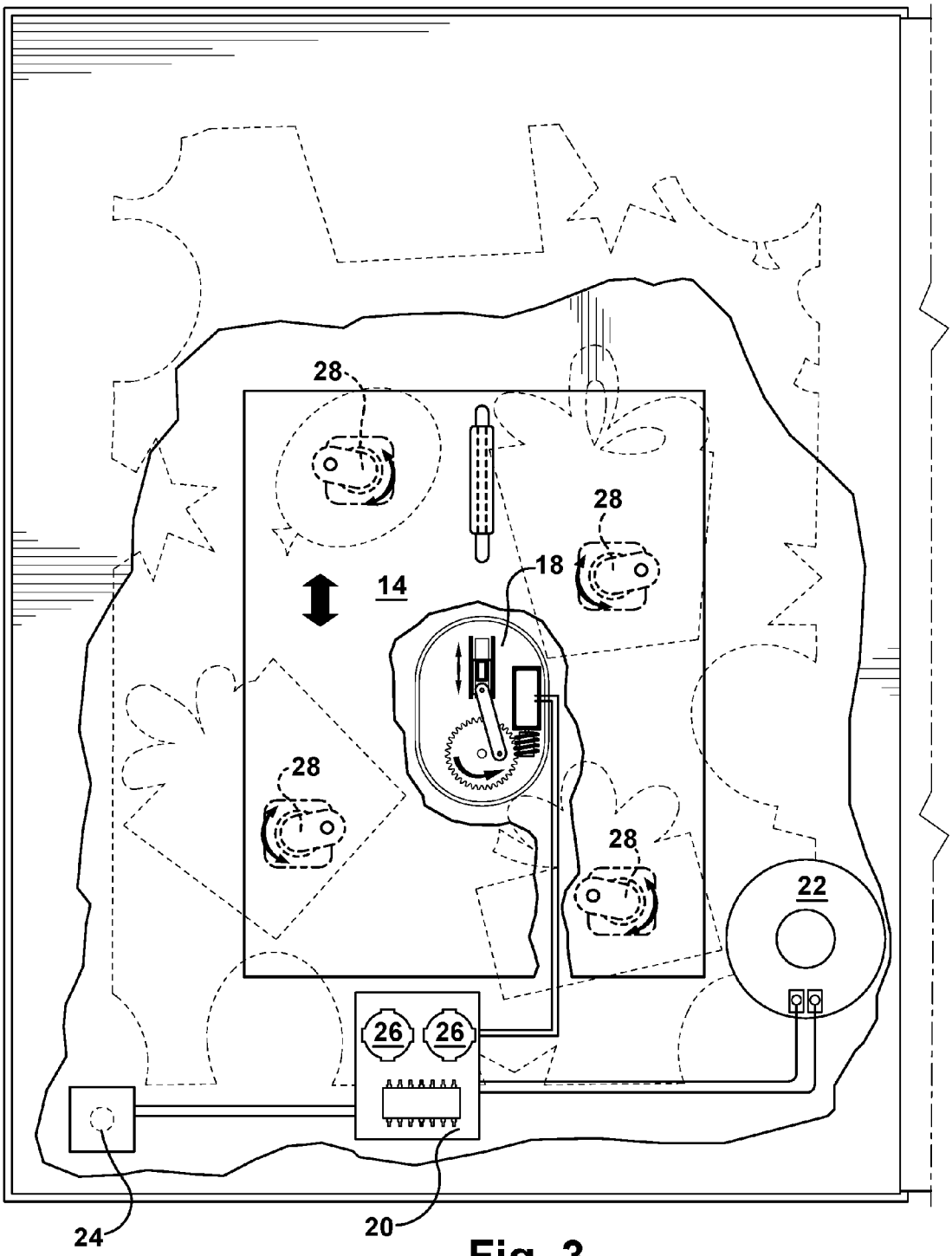
FIG. 3 is a front tear away view the gift box of FIG. 1, showing the internal mechanics/electronics.
Figure 4:
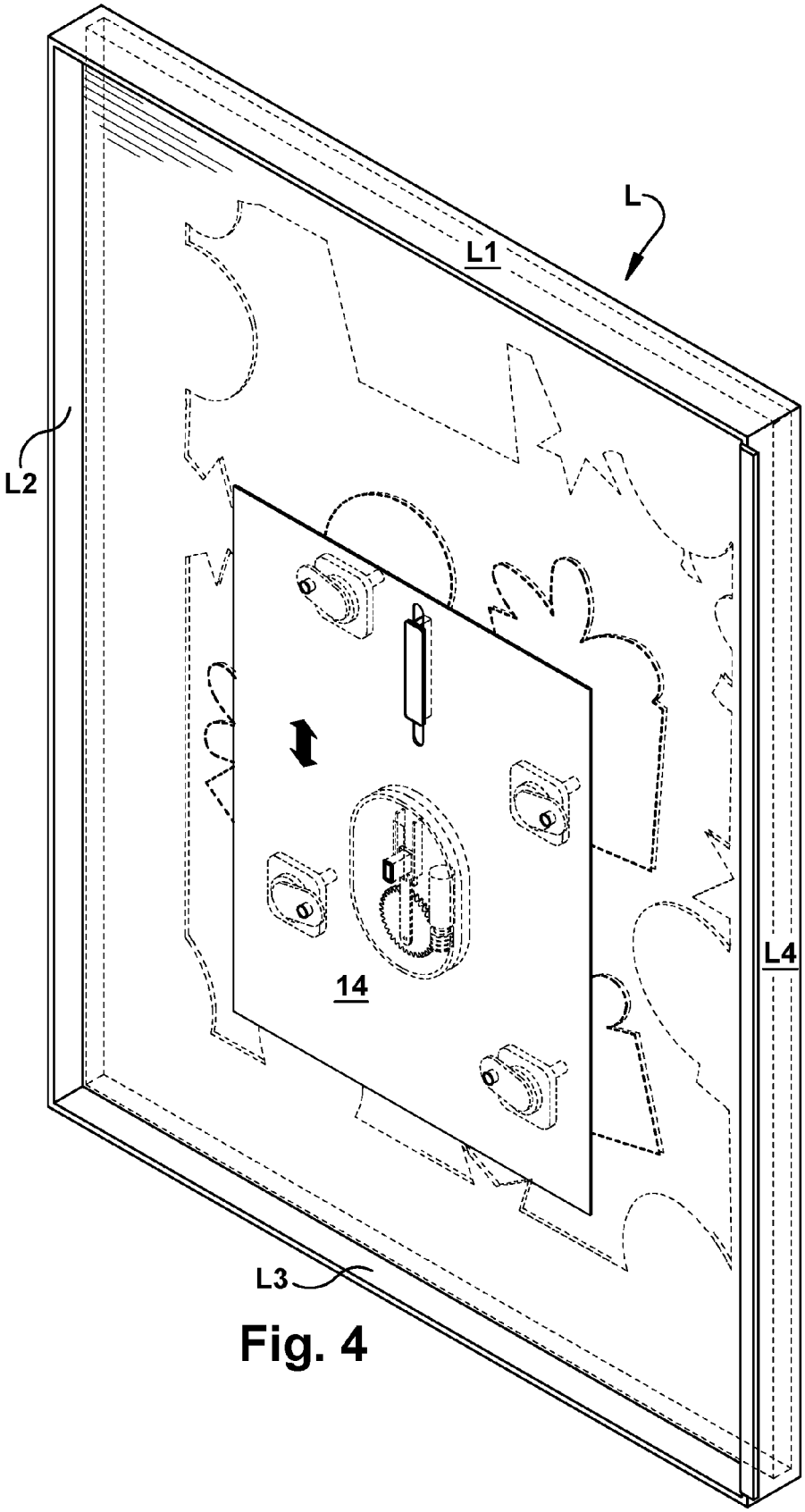
FIG. 4 is a perspective view of the underside of the lid of the gift box of FIG. 1.
Figure 5:
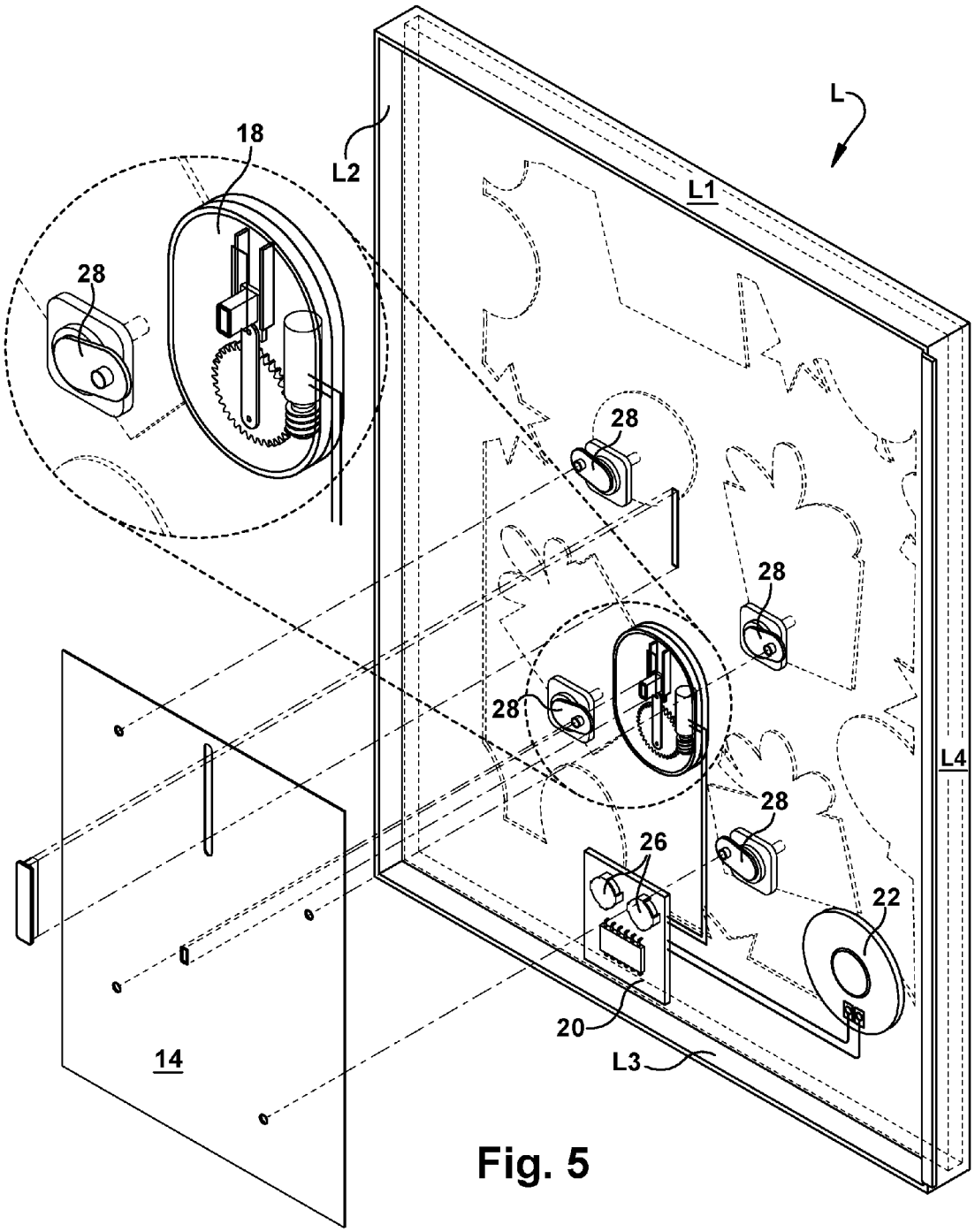
FIG. 5 is a partial exploded view and close up view of the motor of FIG. 4.

In a first embodiment, shown in FIGS. 1-6, the gift box 100 of the present invention contains a hinged lid L which is constructed similar to a shadow box. A shadow box is a closed front case containing an object or objects therein. The placement of the object or objects creates a depth effect created by their relative heights from the backing. In this case, the lid L contains a closed area or cavity in the uppermost to top portion of the lid L. A backing panel 12 is positioned perpendicular to and between the four sides or edges L1, L2, L3, L4 of the lid L. A cover panel L5, which in this embodiment is made of a transparent material, is positioned perpendicular to and between the four sides or edges L1, L2, L3, L4 of the lid L and parallel and spaced apart from the backing panel 12. The area between the backing 12 and cover L5 panels creates a first closed cavity wherein one or more objects 16 are contained. At least one of the one or more objects 16 is a mobile object which is connected to a motor module 18. When the motor module 18 is activated, the mobile object 16 is set in motion. The motion may be an up-and-down, back-and-forth, bouncing, vibrating, circular, or any such physical movement. In a preferred embodiment, the mobile object 16 is a die cut shape. The die cut shape may be formed into any conceivable shape, including but not limited to: a person or character; an animal; a flower; a car; a balloon; a tree; and a star, etc. In the embodiment shown in FIGS. 1-5, the mobile objects 16 are die cut shapes shaped like gifts/presents and balloons. A second closed cavity located directly below the first closed cavity, contains the electronic components of the gift box 100. This second cavity and enclosed electronic components are hidden from view and can be attached to objects contained in the first cavity through one or more openings in the backing panel 12. These electronic components may include, but are not limited to: a circuit board 20; an integrated circuit chip; a speaker 22; a memory storage device; a power source 26; a motor 18; a light; a switch 24, related circuitry and wiring; and any other item which is required or which facilitates audio capabilities, motor movement, light illumination, or any other special effect. These components are readily known to one having skill in the art so will not be discussed herein in further detail. The at least one of the one or more objects contained in the first cavity (or shadowbox portion of the gift box) is connected to the motor 18. In a preferred embodiment, the motor 18 is connected to the one or more mobile objects 16 by a planar sheet material 14, as shown in FIGS. 3 and 4. Each of the one or more mobile objects 14, contains a pivotable attachments 28 attached to the back surface thereof (the side facing away from the top surface of the box). Each of the pivotable attachments 28 attached to each of the mobile objects 16 is attached to the planar sheet material 14 such that when the motor 18 is activated, it effects movement of the planar sheet 14 which in turn effects movement of the one or more mobile objects 16. Each pivotable attachment 28 has a limited range of movement which will cause a back-and-forth, up-and-down or other reciprocating motion. Other types of attachment mechanism can be used which may effect a different type of movement, such as fully rotational movement and the like. The cover panel L5 over the first cavity is transparent so that the items (mobile objects 16) contained within the first cavity are visible from the top of the box 100. A decorative frame F may border the transparent cover panel 14, such as is shown in the figures. In a preferred embodiment, the cover panel 14 is made of acetate but any other transparent material may be used. The gift box 100 may contain one motor 18 connected to one mobile object 16 or one motor 16 connected to two or more mobile objects 16 or the gift box 100 may contain more than one motor 18 connected to two or more mobile objects 16. While the motor, as described herein and shown in the figures, is attached to the one or more mobile objects 16 via a planar sheet 14, other attachment mechanisms may be used. The motor may be directly attached to each mobile object or may connect to each mobile object via a connection arm or any other such connection mechanism. In a preferred embodiment, the gift box 100 contains a push-button switch 24 which can be accessed through a top surface of the box 100. Pressing the push button 22 activates the motor 18 module thereby causing movement of the at least one mobile object 16. The push button 24 may also control activation of a sound module which is operative to store and replay at least one audio file. When the push-button 24 is pressed audio is replayed through the speaker 22 simultaneous to activation of the motor module 18 and movement of the mobile object 16. In alternate embodiments, additional switches may be used to separately control activation of the sound and motor modules. For example, the press-button switch may be used to initiate the motor module but an additional switch may be used to activate the audio, upon, for example, opening the gift box by removing the lid. Any types of switches may be used in relation to the gift box. Such switches include, but are not limited to: slide switch; a contact switch; a touch-sensitive switch; a light-sensitive switch; a tilt-switch; a motion-sensitive switch; or any other type of switch. One or more LED lights may also be contained within the first cavity and the one or more switches may also control activation thereof. The lights may be programmed to simply turn on or they may blink, twinkle, flash, change colors, or perform other lighting effects.

Figure 6:
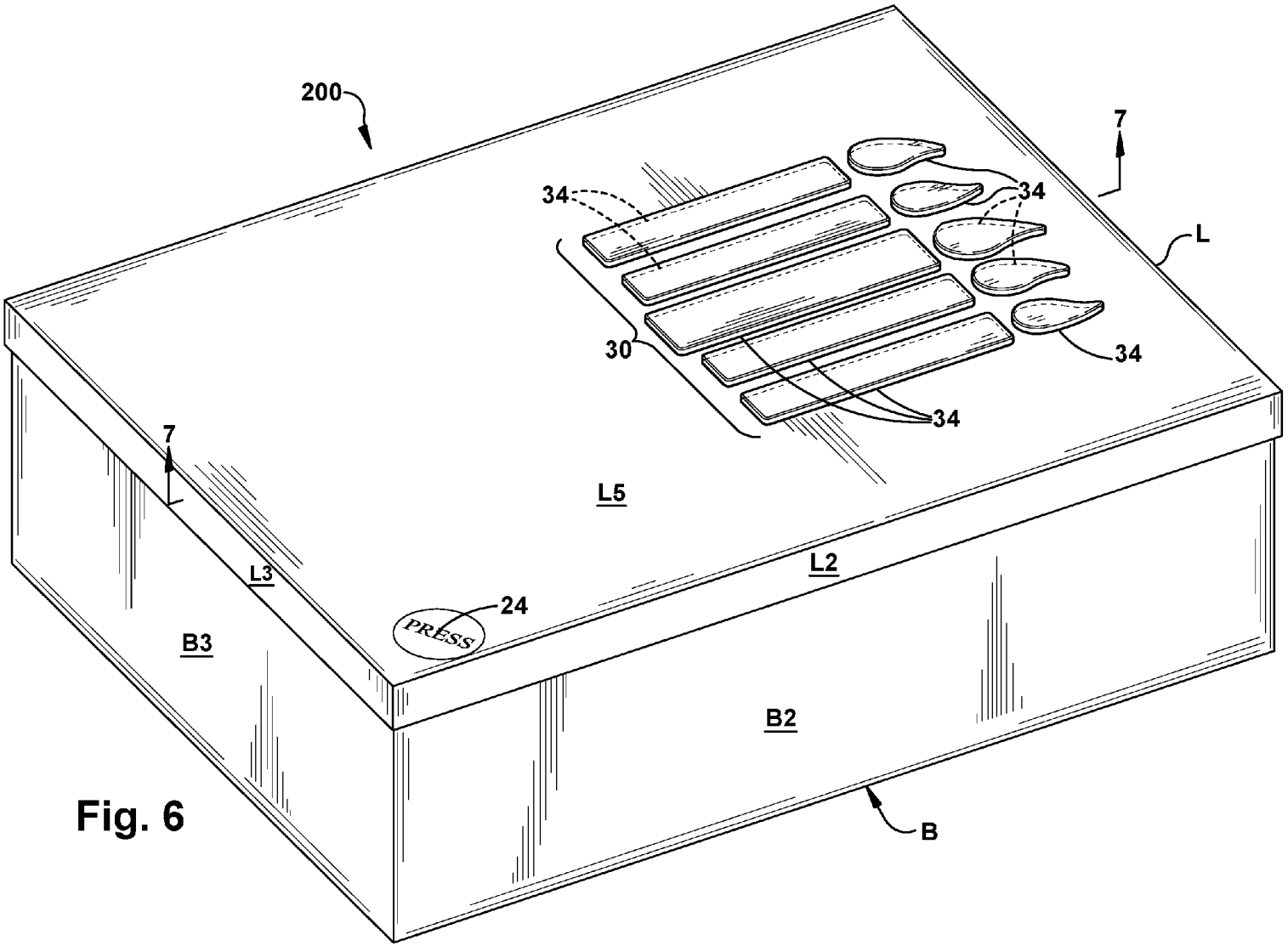
FIG. 6 is a perspective view of a second embodiment of the gift box of the present invention.
Figure 7:
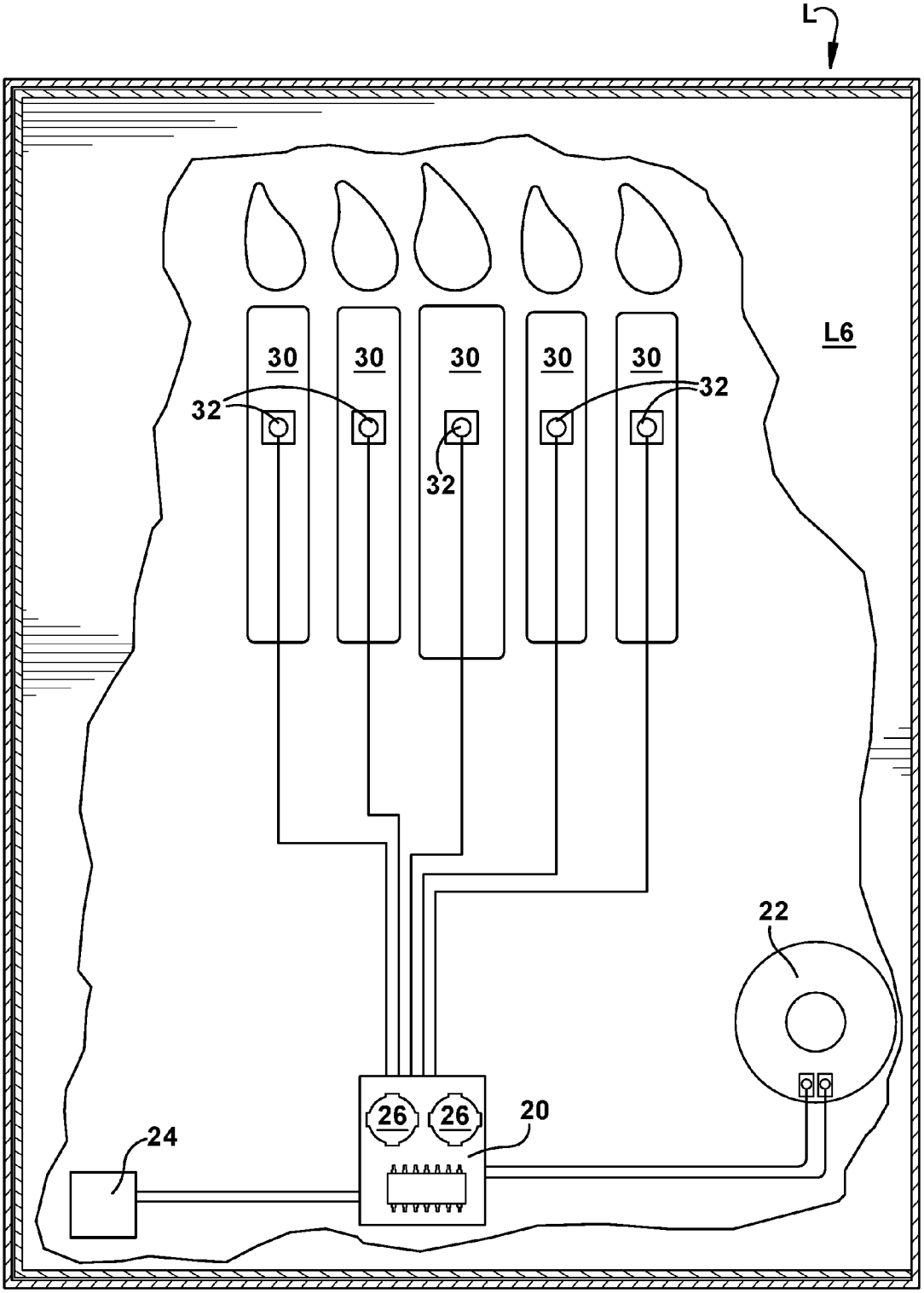
FIG. 7 is a front tear away view of the gift box of FIG. 6.

In a second embodiment, shown in FIGS. 6 and 7, the gift box 200 of the present invention contains a three-dimensional design 30 which protrudes from the upper surface L5 of the gift box lid L. In a preferred embodiment, the three-dimensional design 30 is molded out of silicone. Beneath the design are contained one or more LED (or other type of) lights 32 which illuminate the design 30 from beneath when activated. The box lid L contains at least one hidden cavity contained therein. The cavity is created between an upper panel (which is also to top surface of the gift box) L5 and a lower panel L6 which is parallel to and spaced apart from the upper panel L5, and four side panels L1, L2, L3, L4 of the lid L creating a closed cavity therebetween. Electronic components such as those described above with referenced to the first embodiment described in the paragraph directly above, may be contained in the cavity. As noted above, one or more LED lights 32 are positioned beneath the three-dimensional design 30 so as to illuminate it from below. The three dimensional design 30 can be made from a single piece of silicone (or other material) with various portions protruding upward into a three dimensional structure. The three-dimensional portions extend upward through shaped openings on the top surface L5 of the gift box lid L. Alternatively, the three-dimensional design 30 can contain more than one separate or unconnected pieces. The three dimensional shape 30 or shapes may be formed into any conceivable shape. For example, as shown in FIGS. 6 and 7, the shape 30 may be like a candle or series of candles. Alternatively, the shape may take the form of balloons, stars, hearts, etc. As described in the first embodiment, a press button switch 24, which is accessed through the top or uppermost surface L5 of the gift box lid L, controls illumination of the lighting effects. The press-button 24 may operate as a toggle switch wherein a first push of the press-button causes the one or more LED lights 32 beneath the three-dimensional design 30 protruding from the top surface L5 of the gift box lid L to turn on and a second push of the press-button 24 may cause the one or more LED lights 32 to turn off. The lights 32 may be programmed to blink or flash (repetitive on/off), twinkle (two or more lights with fast alternating blink), slow glow (starts as dim light that progressively gets brighter), or any other such illumination pattern. Different timing patterns may also be used with the different lighting effects. The one or more LED lights 32 may also be of the same or different colors. The lights 32 may also be programmed to change color. The three-dimensional design 30 may be clear so that the color of the LED light shows through or the design may be of color so that a white or clear light therebelow will illuminate the color of the design. In addition to causing the one or more LED lights 32 to turn on and off, the press-button switch 24 may also initiate playback of one or more audio file which are saved within a memory device within the gift box lid L.

The gift box embodiments described herein are intended as preferred examples and are not intended to limit the invention in any way. The size and shape of the gift box may vary and the number, type, and location of the electronic components, switches, mobile objects and lights can be changed while still remaining within the scope of the present invention. Also, the mechanics and electronics are described herein and shown in the figures as being located in the lid of the box, however, they may alternatively be located within the base of the box or in both the lid and base. While a press or push-button switch has been described herein with respect to the preferred embodiments, other types of switches, such as, for example, slide switch, contact switch, touch sensitive switch, light sensitive switch, sound sensitive switch, or any other such switch which is known to one having skill in the art may be used. Also, while one embodiment has been described as having sound and motor movement and the other having lighting effects and sound, the gift box of the present invention may contain light, sound and motor movement or may contain other special effects including confetti release, pop-up structure, or any other type of special effect. Additionally, the gift box embodiments described herein may contain a microphone and record module operative to record, save and playback at least one personalized message recorded by a user. The at least one personalized message can be replayed before, during, after or in place of a pre-recorded audio file. The personalize message may be played before a pre-recorded audio file to, for example, introduce the pre-recorded audio clip or may be played after the pre-recorded audio file to, for example, leave a personalized message to end the audio experience, or the personalized message can be played simultaneously with the pre-recorded audio file, wherein a user may sing along to a pre-recorded song or instrumental audio clip, karaoke-style.

The invention claimed is:

1. A gift box comprising:

a box base having an empty interior space for receiving a gift item therein, the box base created by four side panels and a floor panel;

a box lid operative to fit over the box base and closing the empty interior space therein, the box lid having one or more shaped openings on a top surface thereof;

at least one hidden cavity contained within the box lid;

a three-dimensional design which protrudes upward from the top surface of the box lid through the one or more shaped openings on the top surface of the box lid;

one or more lights contained beneath the three-dimensional design;

a light module contained within the at least one hidden cavity, the light module operative to illuminate the one or more lights upon activation;

a switch operative to activate the light module.

2. The gift box of claim 1 further comprising a sound module operative to store and playback at least one audio file through a speaker.

3. The gift box of claim 2, wherein the switch is operative to control activation of the sound module.

4. The gift box of claim 1, wherein the three-dimensional design is made of silicone.

5. The gift box of claim 1, wherein the three-dimensional design is transparent.

6. The gift box of claim 1, wherein the three-dimensional design is translucent.

7. The gift box of claim 1, wherein the box lid is permanently attached to the box base along one side edge.

8. The gift box of claim 1, wherein the switch is a press button switch.

* * * * *